US010434370B2

(12) United States Patent
Brieu et al.

(10) Patent No.: US 10,434,370 B2
(45) Date of Patent: Oct. 8, 2019

(54) GYMNASTICS APPARATUS RENOVATION KIT AND PROCESS

(71) Applicant: GYMNOVA, Marseilles (FR)

(72) Inventors: Emmanuel Brieu, Marseilles (FR); Morgane Charbonneau, Marseilles (FR); Jean-Claude Dubout, Belcodene (FR)

(73) Assignee: GYMNOVA, Marseilles (FR)

( * ) Notice: Subject to any disclaimer, the term of this patent is extended or adjusted under 35 U.S.C. 154(b) by 140 days.

(21) Appl. No.: 15/657,949

(22) Filed: Jul. 24, 2017

(65) Prior Publication Data

US 2019/0022464 A1 Jan. 24, 2019

(51) Int. Cl.

| | |
|---|---|
| ***A63B 26/00*** | (2006.01) |
| ***A63B 4/00*** | (2006.01) |
| ***A63B 5/12*** | (2006.01) |

(52) U.S. Cl.

CPC ..... *A63B 26/00* (2013.01); *A63B 4/00* (2013.01); *A63B 5/12* (2013.01); *A63B 2209/02* (2013.01); *A63B 2209/10* (2013.01); *A63B 2225/30* (2013.01)

(58) Field of Classification Search

CPC .. A63B 26/00; A63B 5/12; A63B 4/00; A63B 2209/02; A63B 2225/30; A63B 2209/10; A63B 2209/00; A63B 2225/09; A63B 2053/0408; A63B 2210/50

USPC ..... 482/34, 38

See application file for complete search history.

(56) References Cited

U.S. PATENT DOCUMENTS

| | | | | |
|---|---|---|---|---|
| 3,990,697 | A * | 11/1976 | Reuther | A63B 4/00 482/34 |
| 4,105,201 | A * | 8/1978 | L'Ecuyer | A63B 4/00 482/34 |
| 4,272,073 | A * | 6/1981 | Grosser | A63B 4/00 482/34 |
| 6,663,537 | B2 * | 12/2003 | McCoy | A47G 27/0418 482/14 |
| 2002/0177508 | A1 * | 11/2002 | Eyman, Jr. | A63B 4/00 482/23 |
| 2006/0276305 | A1 * | 12/2006 | Schank | A63B 4/00 482/25 |

(Continued)

OTHER PUBLICATIONS

Mary Martin. Beam Band Aid. Published Nov. 23, 2014. (https://marytmartin20.wordpress.com/2014/11/23/beam-band-aid/) (Year: 2014).*

*Primary Examiner* — Andrew S Lo

(74) *Attorney, Agent, or Firm* — Young & Thompson

(57) ABSTRACT

Disclosed is a gymnastics apparatus renovation kit including a cover adapted to fit tightly on a gymnastics apparatus to be renovated. The cover has an elongated shape extending in a longitudinal direction, the elongated shape corresponding to the shape of a gymnastics apparatus. The cover includes an upper face, two longitudinal lateral faces, two end faces, and an open lower face. The renovation kit also includes two rods, each rod being passed in a hem formed at the bottom of each lateral face of the cover and extending throughout the length of the cover. The renovation kit further includes links for joining the rods together in a transversal direction, tending to bring the rods closer together. Also disclosed is a corresponding renovation process and to a renovated gymnastics apparatus.

20 Claims, 6 Drawing Sheets

(56) References Cited

U.S. PATENT DOCUMENTS

| | | | | |
|---|---|---|---|---|
| 2009/0093343 | A1* | 4/2009 | Gallus | A63B 4/00 482/34 |
| 2014/0011641 | A1* | 1/2014 | Winn | A63B 4/00 482/25 |

* cited by examiner

GYMNASTICS APPARATUS RENOVATION KIT AND PROCESS

TECHNICAL FIELD

The invention relates to the technical field of the apparatuses for artistic gymnastics, and more specifically to the field of balance beams and pommel horses.

A balance beam, also simply called "beam", is an apparatus used in artistic gymnastics to balance on. It is generally an elongated rectangular beam raised from the floor on a leg or a stand at both ends. The beam is commonly made of aluminium or any other equivalent material having similar mechanical properties and good durability.

BACKGROUND OF THE INVENTION

Balance beams and pommel horses are generally covered in order to protect them from all the scrapes and bumps and to provide comfort of use. Several types of material such as suede, leather or any other suitable non-slippery material can be used.

Covers are generally glued, stapled or attached to the gymnastics apparatus using convenient means.

While a variety of covered Balance beams and pommel horses are currently available, they suffer from the drawback of not providing an easily and quickly replaceable cover. Indeed, when the cover is damaged or worn-out, the user is obliged to send the complete apparatus to a factory to repair it. This generates many costs and is a considerable waste of time.

In addition, if renovation is envisioned using the covers commonly known in the prior art directly on the worn cover, a problem of universality arises. Indeed, the currently known covers present the disadvantage of not being versatile, meaning that a cover can be used for a specific gymnastics apparatus only. In other words, covers currently available are only conceived for the specific apparatuses they are covering due to for instance the position of the legs which is not the same for all the apparatuses available on the market. Using laces to tighten a cover is not a convenient solution, as a suitable distribution of the tension is difficult to obtain.

As such, it is desirable to have an improved cover that is easily and quickly put in place, cost efficient and that can fit most of the gymnastics apparatuses available on the market, in particular balance beams and pommel horses.

BRIEF SUMMARY OF THE INVENTION

The invention relates to a gymnastics apparatus renovation kit comprising a cover adapted to fit tightly on a gymnastics apparatus to be renovated. The cover has an elongated shape extending in a longitudinal direction, the elongated shape corresponding to the shape of a gymnastics apparatus. The cover comprises an upper face, two longitudinal lateral faces, two end faces, and an open lower face. The renovation kit also comprises two rods, each rod being passed in a hem formed at the bottom of each lateral face of the cover and extending throughout the length of the cover. The renovation kit further comprises links for joining the rods together in a transversal direction, tending to bring the rods closer together.

This renovation kit enables the user to deal with a worn-out cover by placing the new cover directly on the old one. The renovation is thus inexpensive, easy and quick to perform. It also presents the advantages of being light and versatile, meaning that it can be used for almost all types of beams and pommel horses. Thanks to the rods and transversal links, the tension of the cover is easily adjusted throughout the beam and the pommel horse.

Each hem may end with a closed pocked adapted to receive one end of a rod.

The renovation kit may comprise 5 to 100 links, for example 28 links. Each link may be made of a flexible strip adapted to be successively passed around each rod. For example, each link may be formed by a hook-and-loop fastener. Such hook-and-loop fastener may be of a type having two faces such that each of the two faces can cling to itself and to the other face.

Each rod of the renovation kit may be made of PVC or fiber-reinforced plastics. Each rod may comprise glass fibers and/or carbon fibers. For example, each rod may have a substantially round section having a diameter comprised between 3 and 8 millimeters.

The end faces of the cover may be made of a resilient material. This resilient material is for example spandex.

The upper face and the two longitudinal lateral faces of the cover may have an external surface made of PVC, leather, suede, or imitation leather.

The renovation kit may also comprise rigid tips adapted to replace damaged ends of a gymnastics apparatus to be renovated to substantially recover an undamaged end shape.

The gymnastics apparatus renovation kit may be configured to fit on a balance beam. It may be configured to fit on a pommel horse.

The invention also relates to a renovation process for a gymnastics apparatus, comprising:

- providing a gymnastics apparatus renovation kit according to claim 1;
- fitting the cover on a gymnastics apparatus to be renovated;
- inserting one rod in each hem of the cover;
- tightening the cover around the gymnastics apparatus by joining the rods with the links and tensioning the links.

In such a renovation process, the links may be hook-and-loop fasteners having the form of a strip with two faces such that each of the two faces can cling to itself and to the other face. Each link is passed around a first of the two rods, clung to itself to form a loop around the first of the two rods, passed around the second rod, tensioned, and clung to itself to form a loop around a second of the two rods.

The invention finally relates to a renovated gymnastics apparatus comprising an apparatus having a deteriorated surface covered using a gymnastics apparatus renovation kit as previously described.

BRIEF DESCRIPTION OF THE SEVERAL VIEWS OF THE DRAWINGS

Other particularities and advantages of the invention will also emerge from the following description.

In the accompanying drawings, given by way of non-limiting examples.

DETAILED DESCRIPTION OF THE INVENTION

It should be appreciated that even though the invention is described hereafter essentially in relation to balance beam renovation, it is also applicable to pommel horses.

As used in this specification, the words "comprises", "comprising", and similar words, are not to be interpreted in an exclusive or exhaustive sense. In other words, they are intended to mean "including, but not limited to".

Figure 1:
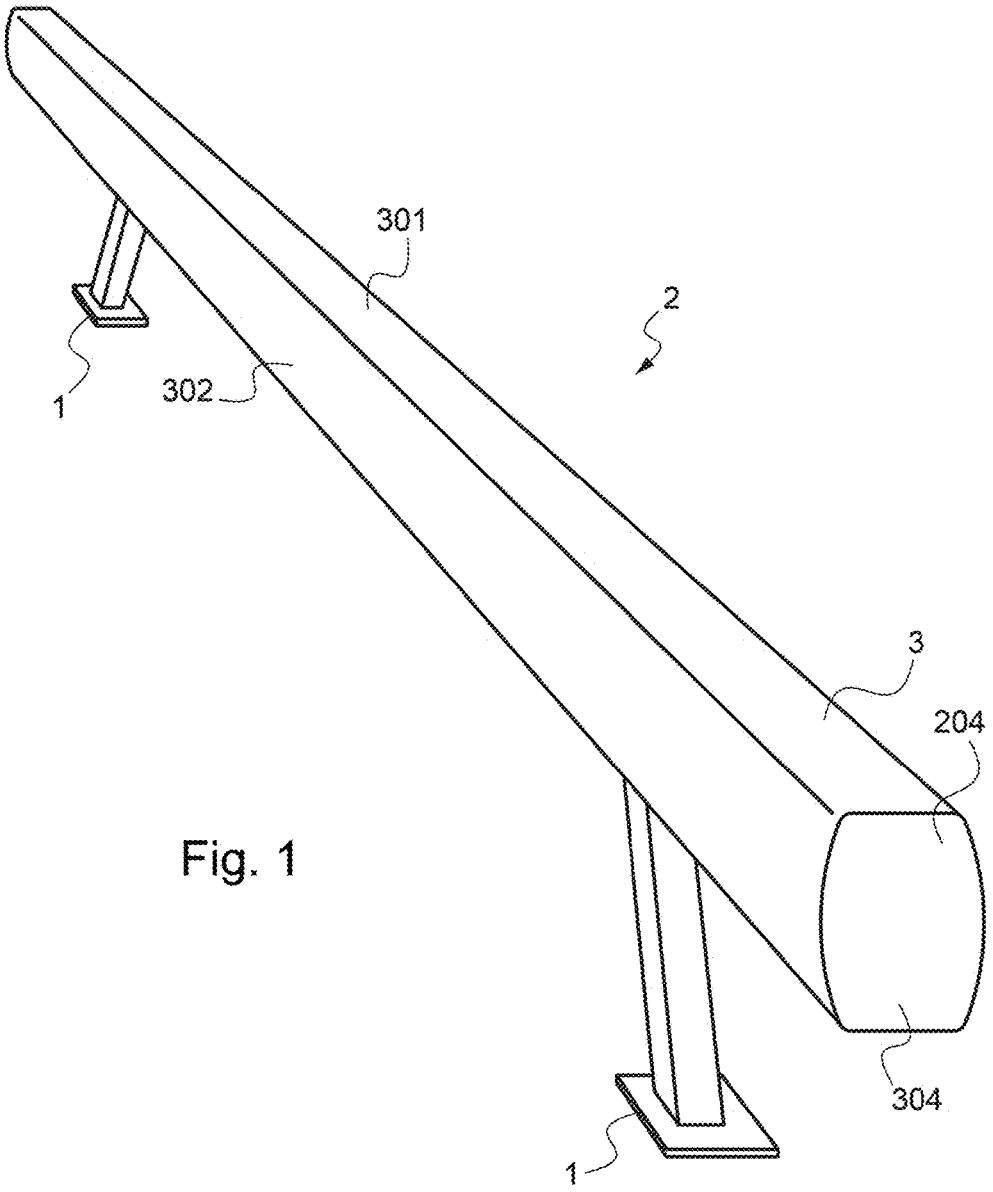
FIG. 1 is a perspective view of a beam covered with a cover of a balance beam renovation kit according to an embodiment of the invention.

Referring now to FIG. 1, the basic components of a conventional balance beam covered with a cover according to the present invention will now be discussed. As represented in this figure, the cover 3 is put in place on an elongated beam 2.

In the represented embodiment, the beam 2 is supported by a pair of beam supports 1. These supports 1 maintain the beam 2 in a stable position even when used by a gymnast. They can provide height adjustment or even be elastically adjustable providing gymnasts several stiffness positions. The beam 2 can be made of any appropriate material such as wood or aluminium. The beam 2 is covered by a cover 3 that fits tightly on it. The cover 3 comprises an upper face 301, two longitudinal lateral faces 302, an open down face 303 and two end faces 304.

Figure 9:
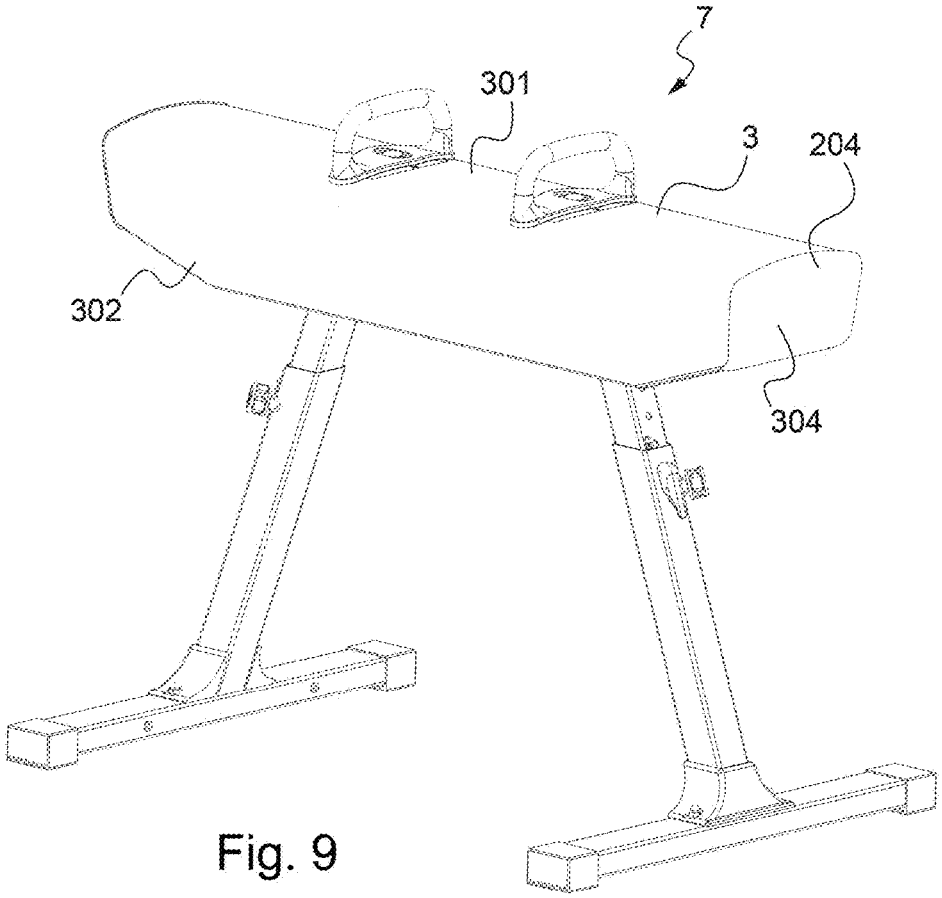
FIG. 9 is perspective view of a pommel horse covered with a cover of a pommel horse renovation kit according to an embodiment of the invention.

As mentioned previously, the renovation kit is also adapted for pommel horses. Thus, FIG. 9 shows a pommel horse 7 covered with a cover 3 according to the present invention.

Cover 3 is manufactured from a non-slippery material, for instance PVC (polyvinyl chloride) coated fabric. PVC coated fabric presents the advantages of being easy to clean, weather-resistant, and has excellent strength and durability.

The cover 3 is preferably manufactured from an appropriate material making it possible to be fully and easily stretched and tensioned about beam 2. For aesthetic and durability purposes and as alternatives to PVC coated fabric, cover 3 can be manufactured from leather, suede or imitation leather which may be attached to a support layer.

Since longitudinal resilience is desired for cover 3, end faces 304 are preferably made of a resilient material such as spandex. Spandex is also called elastane or Lycra™. Spandex presents advantageous elasticity properties which provide it with desirable stretching and strength characteristics. The end faces 304 provides most of the longitudinal resilience of the cover 3.

A high elasticity rate of the end faces 304 is advantageous to accommodate the length of the beam 2 and to tension the upper face 301 and lateral faces 302 of the cover 3 in the longitudinal direction. Tear strength is important to prevent tearing at the seams of the end faces 304.

Figure 8:
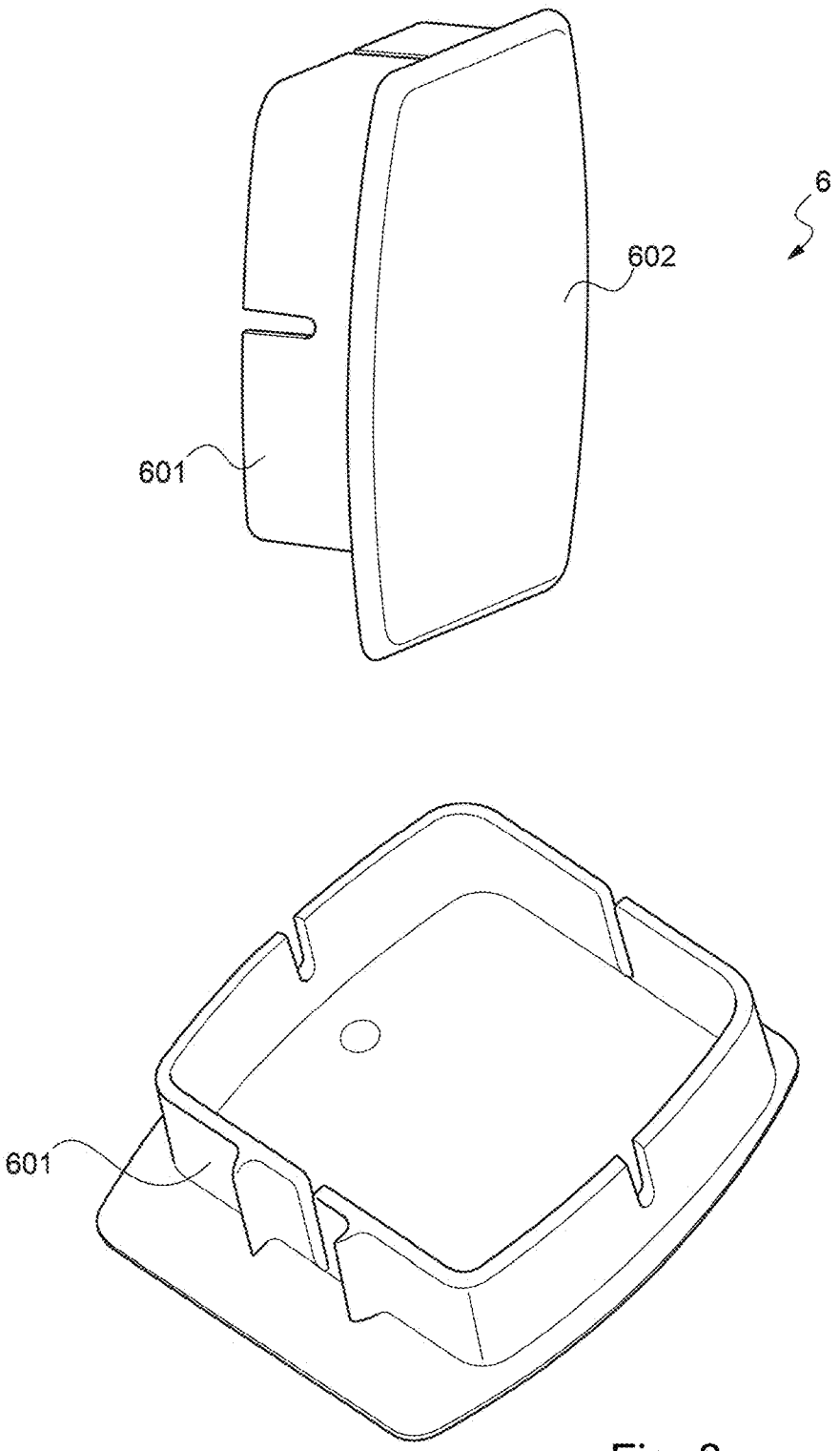
FIG. 8 contains two views of the optional rigid tips which may be fastened to the end faces of the beam.

For more strength and durability, to protect beam 2 or to replace damaged ends, rigid tips 6 can be fastened to each of the end faces 304. An illustration of an embodiment of rigid tips 6 is provided in FIG. 8.

Rigid tips 6 have a form such that they can fit into the beam ends 204. In the illustrated embodiment, the tips 6 have a hollow part 601 projecting from a planar part 602. Tips 6 may be made of plastics.

Figure 2:
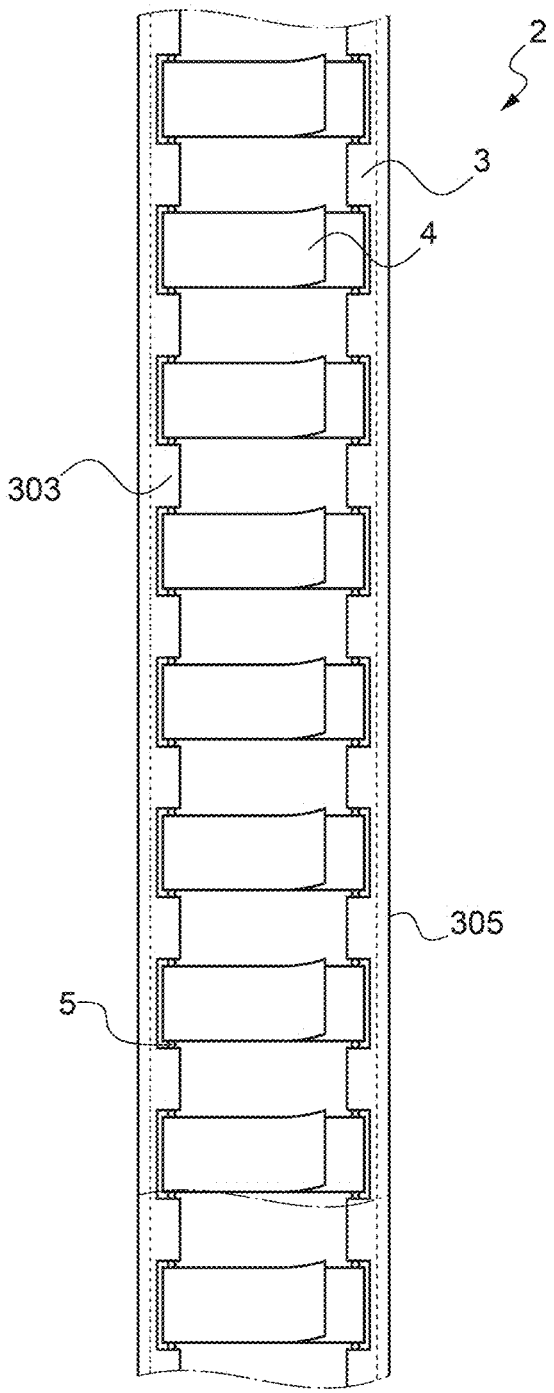
FIG. 2 is view from below of the covered beam of FIG. 1.

As shown in FIG. 2, cover 3 is attached to the beam 2 thanks to several links 4. The number of links 4 depends on the dimension of the beam 2. It may vary from 5 to 100 links, and preferably from 10 to 40 links. For a standard balance beam which generally presents a length of 16 feet (500 centimeters), for example 28 links are required for good tightening of the cover 3. As to pommel horses which generally have a length of 5.2 feet (160 centimeters), 10 links are preferably required.

Links 4 join two rods 5 passed through the two respective sides of cover 3. Rods 5 are joined together in a transversal direction and brought closer together thanks to the links 4.

In the represented embodiment, links 4 are hook-and-loop fasteners. The hook-and-loop fasteners are of a type having two faces such that each of the two faces can cling to itself and to the other face. This type of link 4 presents the advantage of being quickly and easily mounted.

According to an embodiment of the invention, it is possible to use mixed hook-and-loop fasteners (male-female) on the same face. This increases the areas available for attachment depending on the cases encountered. Moreover, this solution for tightening cover 3 is very simple and does not necessitate from the user to cut off the excess length of the fasteners.

However, links 4 can also be of any other adequate type. "Adequate" should be understood as capable of tightening cover 3. For example, traditional hook-and-loop fasteners, having on a same face hooks on a first longitudinal portion and loops on a second longitudinal portion may be used (provided that the hook and loop portions are appropriately dimensioned and positioned). Possible excess length of the fasteners may be cut after the cover is sufficiently tensioned over the gymnastics apparatus to be renovated.

Figure 4:
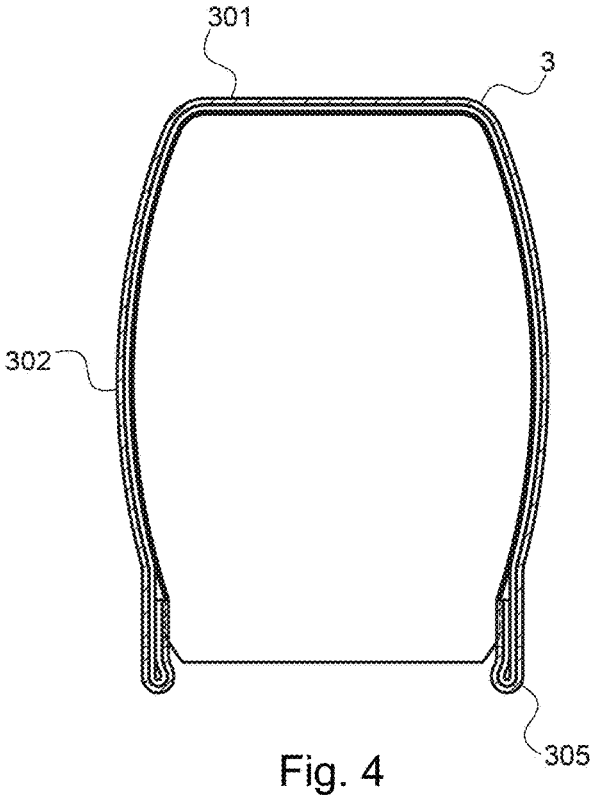
FIG. 4 is a cross-sectional view of the balance beam renovation kit on section line A-A shown in FIG. 3.
Figure 5:
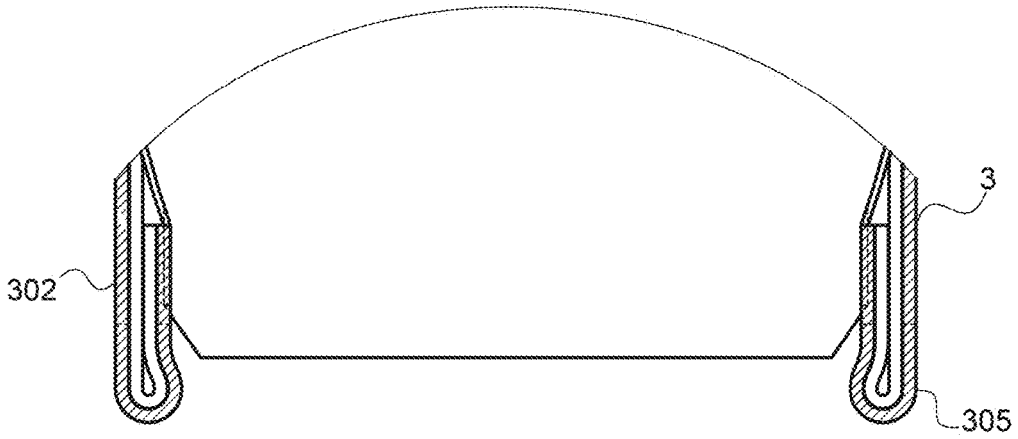
FIG. 5 is a detail view of FIG. 4.
Figure 6:
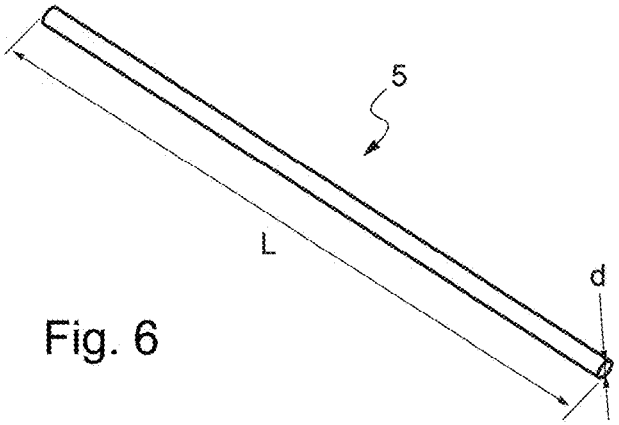
FIG. 6 is a view of a rod used to maintain the cover under tension.

As can be seen in FIGS. 4 and 5, the down face 303 of cover 3 is folded upwards and sewn, thus forming a hem 305 on each side of the cover 3. Each of the two rods 5, illustrated in FIG. 6, is passed through a respective hem 305. For good tightening, rods 5 preferably have a round section with a diameter d comprised between 3 and 8 millimeters. The length L of rods 5 depends on the length of the beam 2.

Rod 5 can be made of plastics such as PVC, or fiber-reinforced plastics. Hence, rods 5 can comprise glass fiber and carbon fiber. The use of such a material improves the mechanical properties of rods 5, such as their tensile strength, shear stiffness and bending modulus. Moreover, unlike metals, plastic materials have no yield point. Thus, rods 5 will not dent and the impact mechanical properties are also improved. This property is very important given the number of impacts balance beams are generally subjected to.

Rods 5 provide a distribution of the clamping tension over the entire length of the cover 3 even if certain links 4 are not used.

Therefore, rods 5 make it possible to bypass legs which are not the same depending on the different beams and their leg positions.

Cover 3 places a slight vertical tension or load on beam 2. Thus beam 2 is slightly compressed by cover 3. Links 4 and rods 5 enable the cover 3 to remain tight and distribute the tension all along the beam 2. Hence, they prevent accidents due to slipping caused for example by bumps.

Figure 3:
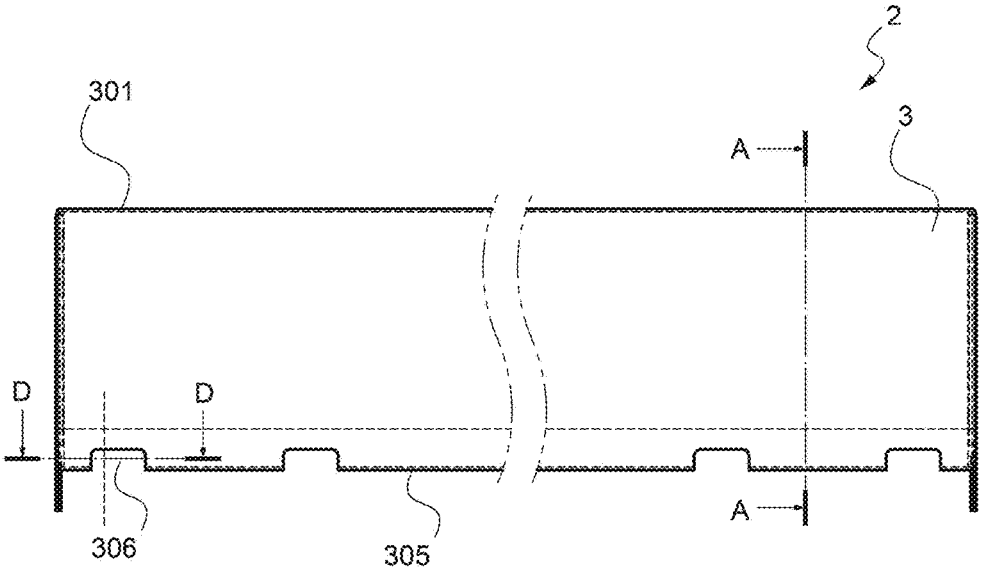
FIG. 3 is a drawing view of the cover of a balance beam renovation kit according to an embodiment of the present invention with its central part not shown.
Figure 7:
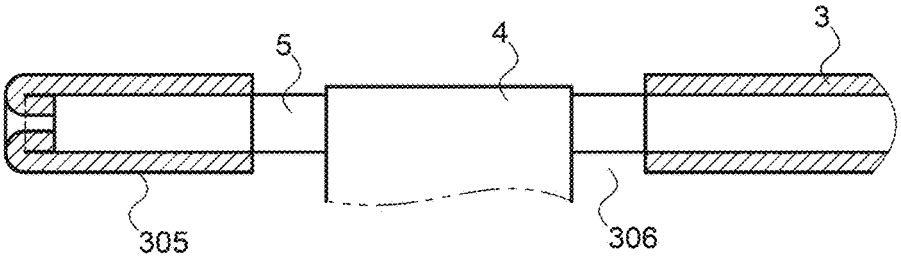
FIG. 7 is a cross-sectional view of FIG. 3 on section line D-D.

As illustrated in FIG. 3, each hem 305 comprises openings 306 in which links 4 are to be accommodated. The dimensions of the openings 306 depends on the links 4 which are used. FIG. 7 shows one of the openings 306 in which one of the links 4 is clung to one of the two rods 5. Cover 3 is adjustable according to user needs. Indeed, it can be accommodated depending on the dimensions of the beam 2 and the curvature of its lateral faces. Depending on these parameters, an optimal number of links 4 and dimension of the rods 5 are computed. This makes this cover 3 a versatile solution that can be used for different kinds of balance beams. Accordingly, the present invention provides a renovation kit comprising:

a beam cover, two rods, links, and optionally, two end tips.

This renovation kit presents the advantages of being compact and light. More specifically, cover 3, links 4 and end tips 6 are not cumbersome. As for rods 5, thanks to their flexible manufacturing material, they are delivered coiled. All this makes this solution a very convenient one.

Furthermore, the renovation kit enables easy and quick renovation of the beam 2. Cover 3 can be placed directly on the worn existing cover. This makes the renovation process, detailed hereafter, feasible by one person alone with no need to send the beam to a factory.

At the start of the process, a first of the end faces 304 of cover 3 is advantageously received within one of the beam ends 204 and the cover 3 is stretched over the perimeter of beam 2. Then the second of the end faces 304 is received within the second of the beam ends 204. If necessary, rigid tips 6 are fixed on each of the beam ends 204 before placing the cover 3 over beam 2. Afterwards, each of the two rods 5 is introduced into a respective hem 305 formed along the entire length of the beam 2 at each side of the down face 303 of the cover 3. Finally, the links 4 are installed around the rods 5 and through each opening 306. The cover 3 is thus properly tightened around the beam 2.

According to the presented embodiment, the links 4 are hook-and-loop fasteners having two faces such that each of the two faces can cling to itself and to the other face. Each link is passed around a first of the two rods 5, clung to itself to form a loop around the first of the two rods 5, passed around the second rod, tensioned, and clung to itself to form a loop around a second of the two rods 5.

This renovation process saves money and time. It does not require any particular tools for its implementation and is adaptable for almost all kinds of balance beams, and pommel horses.

The invention claimed is:

1. A gymnastics apparatus renovation kit comprising a cover adapted to fit tightly on a gymnastics apparatus to be renovated, the cover having an elongated shape extending in a longitudinal direction, the elongated shape corresponding to the shape of the gymnastics apparatus, wherein the cover comprises:

an upper face, two longitudinal lateral faces, two end faces, and an open lower face, wherein the renovation kit comprises two rods, each rod being passed in a hem formed at the bottom of each lateral face of the cover and extending throughout the length of the cover, and wherein the renovation kit further comprises links for joining the rods together in a transversal direction, tending to bring the rods closer together.

2. The gymnastics apparatus renovation kit according to claim 1, wherein each hem comprises openings that leave the rods exposed, so that a link between the rods may be provided at each opening of the hem.

3. The gymnastics apparatus renovation kit according to claim 1, wherein each hem ends with a closed pocket adapted to receive one end of a rod.

4. The gymnastics apparatus renovation kit according to claim 1, wherein the gymnastics apparatus renovation kit comprises 5 to 100 links.

5. The gymnastics apparatus renovation kit according to claim 1, wherein each link is made of a flexible strip adapted to be successively passed around each rod.

6. The gymnastics apparatus renovation kit according to claim 5, wherein each link is formed by a hook-and-loop fastener.

7. The gymnastics apparatus renovation kit according to claim 6, wherein the hook-and-loop fastener is of a type having two faces such that each of the two faces can cling to itself and to the other face.

8. The gymnastics apparatus renovation kit according to claim 1, wherein each rod is made of PVC or fiber-reinforced plastics.

9. The gymnastics apparatus renovation kit according to claim 8, wherein each rod comprises glass fibers and/or carbon fibers.

10. The gymnastics apparatus renovation kit according to claim 8, wherein each rod has a substantially round section having a diameter comprised between 3 and 8 millimeters.

11. The gymnastics apparatus renovation kit according to claim 1, wherein the end faces are made of a resilient material.

12. The gymnastics apparatus renovation kit according to claim 11, wherein the resilient material is spandex.

13. The gymnastics apparatus renovation kit according to claim 1, wherein the upper face and the two longitudinal lateral faces of the cover have an external surface made of PVC, leather, suede, or imitation leather.

14. The gymnastics apparatus renovation kit according to claim 1, wherein the gymnastics apparatus renovation kit comprises rigid tips adapted to replace damaged ends of a gymnastics apparatus to be renovated to substantially recover an undamaged end shape.

15. The gymnastics apparatus renovation kit according to claim 1, wherein the gymnastics apparatus renovation kit is configured to fit on a balance beam.

16. The gymnastics apparatus renovation kit according to claim 1, wherein the gymnastics apparatus renovation kit is configured to fit on a pommel horse.

17. A renovation process for a gymnastics apparatus, comprising:

providing a gymnastics apparatus renovation kit according to claim 1;

fitting the cover on a gymnastics apparatus to be renovated;

inserting one rod in each hem of the cover;

tightening the cover around the gymnastics apparatus by joining the rods with the links and tensioning the links.

18. The renovation process according to claim 17 in which the links are hook-and-loop fasteners having the form of a strip with two faces such that each of the two faces can cling to itself and to the other face, wherein each link is passed around a first of the two rods, clung to itself to form a loop around the first of the two rods, passed around the second rod, tensioned, and clung to itself to form a loop around a second of the two rods.

19. The renovation gymnastics apparatus comprising an apparatus having a deteriorated surface covered using a gymnastics apparatus renovation kit according to claim 1.

20. The gymnastics apparatus renovation kit according to claim 2, wherein the gymnastics apparatus renovation kit comprises rigid tips adapted to replace damaged ends of a gymnastics apparatus to be renovated to substantially recover an undamaged end shape.

* * * * *